US006852679B2

(12) United States Patent
Hartley et al.

(10) Patent No.: US 6,852,679 B2
(45) Date of Patent: Feb. 8, 2005

(54) LUBRICATING OIL COMPOSITION

(75) Inventors: Rolfe J. Hartley, Cranbury, NJ (US); Malcolm Waddoups, Westfield, NJ (US); Ricardo A. Bloch, Scotch Plains, NJ (US); Roger W. Glyde, Bampton (GB); Robert Robson, Abingdon (GB)

(73) Assignee: Infineum International Ltd. (GB)

( * ) Notice: Subject to any disclaimer, the term of this patent is extended or adjusted under 35 U.S.C. 154(b) by 328 days.

(21) Appl. No.: 10/079,798

(22) Filed: Feb. 20, 2002

(65) Prior Publication Data

US 2003/0176297 A1 Sep. 18, 2003

(51) Int. Cl.[7] ..... C10M 141/12

(52) U.S. Cl. ..... 508/365; 508/294; 508/295; 508/371; 508/460; 508/563

(58) Field of Search ..... 508/460, 365

(56) References Cited

U.S. PATENT DOCUMENTS

| | | | | |
|---|---|---|---|---|
| 4,152,499 A | | 5/1979 | Boerzel et al. | 526/52.4 |
| 4,867,890 A | | 9/1989 | Colclough et al. | 252/32.7 E |
| 4,938,880 A | | 7/1990 | Waddoups et al. | 252/32.7 E |
| 5,631,212 A | | 5/1997 | Vrahopoulou | 508/192 |
| 6,147,035 A | * | 11/2000 | Sougawa et al. | 508/192 |
| 6,232,276 B1 | | 5/2001 | Stiefel et al. | 508/363 |
| 6,300,291 B1 | | 10/2001 | Hartley et al. | 508/363 |
| 6,306,801 B1 | * | 10/2001 | Yagishita et al. | 508/292 |
| 6,333,298 B1 | | 12/2001 | Waddoups | 508/373 |
| 6,569,818 B2 | * | 5/2003 | Nakazato et al. | 508/185 |
| 6,596,672 B1 | * | 7/2003 | Carrick et al. | 508/192 |
| 6,599,867 B2 | * | 7/2003 | Hammond et al. | 508/460 |
| 6,613,724 B2 | * | 9/2003 | Strickland et al. | 508/460 |
| 6,638,897 B2 | * | 10/2003 | Ogano et al. | 508/192 |
| 6,645,922 B2 | * | 11/2003 | Dunn et al. | 508/398 |
| 6,645,923 B2 | * | 11/2003 | Dunn et al. | 508/460 |
| 6,660,697 B2 | * | 12/2003 | Dunn et al. | 508/460 |

FOREIGN PATENT DOCUMENTS

| | | | |
|---|---|---|---|
| EP | 1 167 497 A2 | 1/2002 | C10M/169/04 |
| GB | 2359093 A | 8/2001 | C10M/159/18 |

* cited by examiner

*Primary Examiner*—Ellen M McAvoy

(57) ABSTRACT

A lubricating oil composition having less than 0.2 wt. % sulfur, less than 50 ppm chlorine, less than 50 ppm phosphorus, a NOACK volatility of 15 wt. % or less comprising an organo-molybdenum compound, an over-based calcium or magnesium salicylate, a dispersant and a supplemental antioxidant.

11 Claims, No Drawings

LUBRICATING OIL COMPOSITION

The present invention relates to lubricating oil compositions. More particularly, the present invention relates to lubricating oil compositions, which have low levels of phosphorus, chlorine and sulfur and exhibit low volatility.

BACKGROUND OF THE INVENTION

Various legislative and manufacturer's requirements have created a need for passenger car engine lubricants that exhibit reduced amounts of chlorine, sulfur and phosphorus as well as exhibiting reduced volatility. The drive toward reduced chlorine is due to health and environmental concerns associated with disposal of used oils. Increasingly tighter emissions requirements have stimulated research into the effect of the lubricating oil on catalyst efficiency and durability. Results of this research indicate that reduction of sulfur and phosphorus in the oil will improve catalyst durability and efficiency. Improved volatility of the lubricating oil results in greater durability of fuel economy benefits from the lubricant. A second benefit of improved volatility is the increase in the capability of the lubricant for extended drain.

SUMMARY OF THE INVENTION

In accordance with the present invention there has been discovered a lubricating oil composition which comprises an admixture of (a) a major amount of an oil of lubricating viscosity selected from the group consisting of Group II, Group III, Group IV and synthetic ester base stock oils;

(b) an overbased calcium or magnesium salicylate lubricating oil detergent;

(c) an oil soluble organo-molybdenum compound;

(d) an ashless dispersant; and (e) a supplemental antioxidant; said lubricating oil composition containing less than 0.2 wt. % sulfur, less than 50 ppm (by weight) chlorine, less than 50 ppm (by weight) phosphorus and having a NOACK volatility of 15 wt. % or less.

Unless otherwise stated, all amounts of additives are reported on an active ingredient ("a.i.") basis, i.e., independent of the diluent or carrier oil.

Oil of Lubricating Viscosity

The oil of lubricating viscosity may be selected from Group II, III or IV base stocks or synthetic ester base stocks. The base stock groups are defined in the American Petroleum Institute (API) publication "Engine Oil Licensing and Certification System", Industry Services Department, Fourteenth Edition, December 1996, Addendum 1, December 1998. The base stock will have a viscosity preferably of 3–12, more preferably 4–10, most preferably 4.5–8 $mm^2/s$ (cSt) at 100° C.

(a) Group II mineral oil base stocks contain greater than or equal to 90% saturates and less than or equal to 0.03% sulfur and have a viscosity index greater than or equal to 80 and less than 120 using the test methods specified in Table A below.

(b) Group III mineral oil base stocks contain greater than or equal to 90% saturates and less than or equal to 0.03% sulfur and have a viscosity index greater than or equal to 120 using the test methods specified in Table A below.

(c) Group IV base stocks are polyalphaolefins (PAO).

(d) Suitable ester base stocks that can be used comprise the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol 2-ethylhexyl alcohol, ethylene glycol, diethylene glycol monoether, propylene glycol, etc.) Specific examples of these esters include dibutyl adipate, di(e-ethylhexyl) sebacate, din-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic base stock oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

TABLE A

Analytical Methods for Testing Base Stocks

| Property | Test Method |
|---|---|
| Saturates | ASTM D2007 |
| Viscosity Index | ASTM D2270 |
| Sulfur | ASTM D2622, D4292, D4927, or D3120 |

The oil of lubricating viscosity used in this invention should have a viscosity index of at least 95, preferably at least 100. Preferred oils are (a) base oil blends of Group III base stocks with Group II base stocks, where the combination has a viscosity index of at least 110; or (b) Group III base stocks or blends of more than one Group III base stock. Mineral oils are preferred.

Calcium or Magnesium Salicylate Detergent

The present invention requires the presence of at least one overbased calcium or magnesium salicylate lubricating oil detergent. Detergents aid in reducing deposits that build up in an engine and act as an acid neutralizer or rust inhibitor. This in turn reduces engine wear and corrosion.

The calcium or magnesium salicylate detergent used in this invention will be overbased and may be $C_8$–$C_{30}$ alkyl salicylates or mixtures thereof, with $C_{10}$–$C_{20}$ alkyl salicylates being particularly preferred. Preferably, the detergent will have a Total Base Number (TBN) between 100 and 500, more preferably between 150 and 450, and most preferably between 200 and 400. The most preferred detergent for use in this invention is an overbased calcium alkyl salicylate having a TBN between 200 and 400.

The process of overbasing a metal detergent means that a stoichiometric excess of the metal is present over what is required to neutralize the anion of the salt. It is the excess metal from overbasing that has the effect of neutralizing acids which may build up.

In the present invention, the amount of calcium or magnesium salicylate detergents used can vary broadly, but typically will be from about 0.5 to about 5 wt. %, preferably 0.5 to 1.5 wt. %, based on the total weight of the composition.

Molybdenum Compound

For the lubricating oil compositions of this invention, any suitable oil soluble organo-molybdenum compound may be employed. The molybdenum compound will function both as an antiwear and antioxidant additive. Preferably, dimeric and trimeric molybdenum compounds are used. Examples of such oil soluble organo-molybdenum compounds are the dialkyldithiocarbamates, dialkyldithiophosphates, dialkyldithiophosphinates, xanthates, thioxanthates, carboxylates and the like, and mixtures thereof. Particularly preferred are molybdenum dialkylthiocarbamates.

The molybdenum dialkyldithiocarbamate dimer to be used as an additive in the present invention is a compound expressed by the following formula:

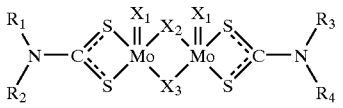

$R_1$ through $R_4$ independently denote a straight chain, branched chain or aromatic hydrocarbyl group; and X1 through X4 independently denote an oxygen atom or a sulfur atom. The four hydrocarbyl groups, $R_1$ through $R_4$, may be identical or different from one another.

Another group of organo-molybdenum compounds useful in the lubricating compositions of this invention are trinuclear (trimeric) molybdenum compounds, especially those of the formula $Mo_3S_kL_nQ_z$ and mixtures thereof wherein the L are independently selected ligands having organo groups with a sufficient number of carbon atoms to render the compound soluble in the oil, n is from 1 to 4, k varies from 4 to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are selected from the group consisting of

1

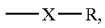

2

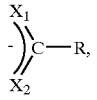

3

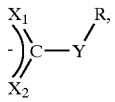

4

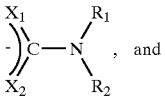

5

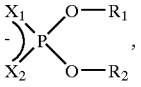

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

Importantly, the organo groups of the ligands have a sufficient number of carbon atoms to render the compound soluble in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, carboxylates, dialkyldithiocarbamate, and mixtures thereof. Most preferred are the dialkyldithiocarbamates. Those skilled in the art will realize that formation of the compounds of the present invention requires selection of ligands having the appropriate charge to balance the core's charge (as discussed below).

Compounds having the formula $Mo_3S_kL_nQ_z$ have cationic cores surrounded by anionic ligands, wherein the cationic cores are represented by structures such as

6

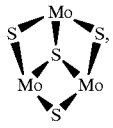

and

7

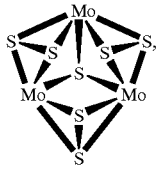

which have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate, i.e., having multiple connections to one or more cores. It is believed that oxygen and/or selenium may be substituted for sulfur in the core(s).

Oil-soluble trinuclear molybdenum compounds are preferred and can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble trinuclear molybdenum compounds can be formed during a reaction in the appropriate solvent(s) of a molybdenum source such as $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble trinuclear molybdenum compound. The appropriate liquid/solvent may be, for example, aqueous or organic.

The ligand chosen must have a sufficient number of carbon atoms to render the compound soluble in the lubricating composition. The term "oil-soluble" as used herein does not necessarily indicate that the compounds or additives are soluble in the oil in all proportions. It does mean that they are soluble in use, transportation, and storage.

A sulfurized molybdenum containing composition prepared by (i) reacting an acidic molybdenum compound and a basic nitrogen compound selected from the group consisting of succinimide, a carboxylic acid amide, a hydrocarbyl monoamine, a phosphoramide, a thiophosphoramide, a Mannich base, a dispersant viscosity index improver, or a mixture thereof, in the presence of a polar promoter, to form a molybdenum complex (ii) reacting the molybdenum complex with a sulfur containing compound, to thereby form a sulfur and molybdenum containing composition is useful within the context of this invention. The sulfurized molybdenum containing compositions may be generally characterized as a molybdenum/sulfur complex of a basic nitrogen compound. The precise molecular formula of these molybdenum compositions is not known with certainty. However, they are believed to be compounds in which molybdenum, whose valences are satisfied with atoms of oxygen or sulfur, is either complexed by, or the salt of one or more nitrogen atoms of the basic nitrogen containing compound used in the preparation of these compositions.

The lubricating compositions of the present invention must contain a minor amount of an oil soluble molybdenum compound. An amount of at least 10 ppm up to about 2,000 ppm of molybdenum from a molybdenum compound must be present in the lubricating oil composition. Preferably, about 500 ppm to 1,000 ppm of molybdenum from a molybdenum compound is used. These values are based upon the weight of the lubricating composition.

Ashless Dispersant

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Dispersants are present in amounts of from 0.5 to 10.0 wt. %, preferably about 1 to 3 wt. %. Preferred are polyisobutenyl succinimide dispersants wherein the polyisobutenyl has an Mn of about 500 to 3,000, preferably about 900 to 2,500. A preferred embodiment utilizes polyisobutenyl succinimide dispersants prepared using polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Supplemental Antioxidants

Supplemental antioxidants, i.e., in addition to the organomolybdenum compound, reduce the tendency of base stocks to deteriorate in service which deterioration can be evidenced by the products of oxidation such as sludge and varnish-like deposits on the metal surfaces and by viscosity growth. They are present in amount of from 0.1 to 5.0 wt. %, preferably 0.25 to 1.0 wt. %. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl substituted diphenylamine, alkyl substituted phenyl and napthylamines, phosphorous esters, metal thiocarbamates, ashless thiocarbamates and oil soluble copper compounds as described in U.S. Pat. No. 4,867,890. Most preferred are the dialkyl substituted diphenylamines, wherein the alkyl is $C_4$–$C_{20}$, such as dinonyl diphenylamine.

Preferred, but optional ingredients, are friction modifiers, lube oil flow improvers and viscosity modifiers.

Friction Modifiers

At least one organic oil soluble friction modifier may preferably be incorporated in the lubricating oil composition. Typically, the friction modifier makes up about 0.02 to 2.0 wt. % of the lubricating oil composition. Preferably, from 0.05 to 1.0, more preferably from 0.1 to 0.5 wt. % of the friction modifier is used.

Friction modifiers include such compounds as aliphatic amines or ethoxylated aliphatic amines, aliphatic fatty acid amides, aliphatic carboxylic acids, aliphatic carboxylic esters of polyols such as glycerol esters of fatty acids as exemplified by glycerol oleate, which is preferred, aliphatic carboxylic ester-amides, aliphatic phosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Lubricating Oil Flow Improver

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like. These may be used in amounts of from 0.01 to 5.0 wt. %, preferably about 0.1 to 3.0 wt. %. They are preferably used when mineral oil base stocks are employed but are not required when the base stock is a PAO or synthetic ester.

Viscosity Modifier

The viscosity modifier (VM) functions to impart high and low temperature operability to a lubricating oil. The VM used may have that sole function, or may be multifunctional. It may be present in amounts of from 0.01 to 20.0 wt. %, preferably about 1.0 to 10.0 wt. %. These are preferably employed when the base stock is a mineral oil.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. The invention comprising the product results from the admixture of the additive components to form a lubricating oil composition.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass %, preferably 4 to 18 mass %, and most preferably about 5 to 17 mass % of the concentrate or additive package, with the remainder being base stock.

The lubricating oil compositions of this invention will contain less than 50 ppm (by weight) phosphorus, more preferably no phosphorus. Phosphorus-free compositions have been tested in the Sequence IVA wear test with satisfactory results. If phosphorus is present it is preferably in the form of a zinc dihydrocarbyl dithiophosphate (ZDDP) additive wherein the hydrocarbyl comprise primary and/or secondary alkyl groups of about 1–25, preferably 3–12 carbon atoms, and the ZDDP is present is such amounts as to provide less than 50 ppm phosphorus such as 1–45 ppm phosphorus, more preferably 1–25 ppm phosphorus.

It is also necessary that the volatility of the lubricating oil composition, as measured using the NOACK Volatility Test, be about 15 wt. % or less, such as in the range of 4 to 15 wt. %, preferably in the range of 8 to 15 wt. %. The NOACK Volatility Test is used to measure the evaporative loss of an oil after 1 hour at 250° C. according to the procedure of ASTM D5800. The evaporative loss is reported in mass percent.

EXAMPLE

The following oil was prepared and tested according to the ASTM Sequence IVA wear test. Wear data from the test is in the table below Lubricating Oil Formulation

| | | Parts by Weight |
|---|---|---|
| (a) | Calcium salicylate (TBN 260) | 1.00 |
| (b) | Molybdenum trimer dithiocarbamate | 0.67 |
| (c) | Friction modifier | 0.20 |
| (d) | Dispersant | 1.80 |
| (e) | Supplemental antioxidant | 0.50 |
| (f) | Lubricating oil flow improver | 0.14 |
| (g) | Viscosity modifier | 6.40 |
| (h) | Antifoam agent | 0.001 |
| (i) | Group III mineral oil base stocks | 85.80 |

This oil had 0.17 wt. % sulfur, no phosphorus and 22.8 ppm chlorine and a NOACK volatility less than 15% and contained 850 ppm molybdenum.

TABLE

Sequence IVA Data

| ILSAC GF-3 Engine Tests | Results | GF-3 limits |
|---|---|---|
| Sequence IVA (Nissan 2.4L) | Low temp wear | |
| Avg Cam Wear (7-point measurement) | 30.21 microns | 120 microns max |

The Sequence IVA fired engine test is part of the ILSAC GF-3 and API SL specifications for passenger car engine oils. The test measures the ability of the oil to provide wear protection to the valve train. The performance limits require a maximum of 120 microns of wear. The formulation exhibits excellent results against the specified limits. Current passenger car motor oil technology uses phosphorus in the form of zinc dithiophosphate (ZDDP) to ensure passing performance against this requirement. Most oils meeting this requirement are formulated with about 1000 ppm of phosphorus from ZDDP.

What is claimed is:

1. A lubricating oil composition which comprises an admixture of (a) a major amount of an oil of lubricating viscosity selected from the group consisting of Group II, Group III, Group IV and synthetic ester base stock oils;

(b) an overbased calcium or magnesium salicylate lubricating oil detergent;

(c) an oil soluble organo-molybdenum compound;

(d) an ashless dispersant; and (e) a supplemental antioxidant; said lubricating oil composition containing less than 0.2 wt. % sulfur, less than 50 ppm chlorine (by weight), less than 50 ppm (by weight) phosphorus and a NOACK volatility of 15 wt. % or less.

2. The composition of claim 1 where there is present:

0.5 to 5 wt. % of the (b) ingredient;

10–2,000 ppm of molybdenum from the (c) ingredient;

0.5 to 10.0 wt. % of the (d) ingredient; and 0.1 to 5.0 wt. % of the (e) ingredient.

3. The composition of claim 1 or claim 2 which contains no phosphorus.

4. The composition of claim 1 or claim 2 where the (b) ingredient is calcium salicylate of TBN 200–400.

5. The composition of claim 1 or claim 2 where the organo-molybdenum compound is a dialkyldithiocarbamate.

6. The composition of claim 1 or claim 2 wherein the supplemental antioxidant is a dialkyl diphenylamine wherein the alkyl is $C_4$–$C_{20}$ alkyl.

7. The composition of claim 1 or claim 2 wherein the (d) ingredient is a polyisobutenyl succinimide dispersant.

8. The composition of claim 7 wherein the polyisobutenyl used to prepare the dispersant has a terminal vinylidene content of at least 65 wt. %.

9. The composition of claim 1 or claim 2 wherein the composition further comprises a friction modifier, viscosity modifier or a lube oil flow improver.

10. The composition of claim 1 or claim 2 where the (a) ingredient is a mineral oil.

11. The composition of claim 1 or claim 2 which further comprises a zinc dialkyl dithiophosphate in such amount so as to provide 1-25 ppm phosphorus in the lubricating oil composition.

* * * * *